US005752390A

United States Patent [19]

Hyde

[11] Patent Number: 5,752,390

[45] Date of Patent: May 19, 1998

[54] IMPROVEMENTS IN VAPOR-COMPRESSION REFRIGERATION

[76] Inventor: Robert Hyde, 2229 SE. 170th, Portland, Oreg. 97233

[21] Appl. No.: 751,079

[22] Filed: Oct. 25, 1996

[51] Int. Cl.[6] ..... F25B 39/04; F25B 41/00

[52] U.S. Cl. ..... 62/196.4; 62/197; 62/509

[58] Field of Search ..... 62/196.4, 509, 62/DIG. 2, 197

[56] References Cited

U.S. PATENT DOCUMENTS 3,248,895 5/1966 Mauer ..... 62/196.4 X 4,430,866 2/1984 Willitts ..... 62/509 X

*Primary Examiner*—William E. Wayner

*Attorney, Agent, or Firm*—Chernoff, Vilhauer, McClung & Stenzel

[57] ABSTRACT

Conventional vapor-compression refrigeration systems modified for greater efficiencies by installation of a liquid refrigerant level sensor in the drain line after the condenser, the sensor activating a valve in the high pressure vapor line in communication with the refrigerant receiver or reservoir, and the drain line being trapped to prevent vapor in the reservoir from backing up into the condenser.

6 Claims, 4 Drawing Sheets

IMPROVEMENTS IN VAPOR-COMPRESSION REFRIGERATION

BACKGROUND OF THE INVENTION

This invention pertains to vapor-compression refrigeration systems and more particularly to improvements in the efficiency of such systems through modification of the operation of the liquid refrigerant receiver and the plumbing and controls associated therewith.

Fundamental problems associated with all vapor-compression refrigeration systems include premature evaporation of refrigerant due to changing temperatures and pressures within the system, with consequent introduction of vaporous refrigerant into the refrigerant pump and a requirement for excess refrigerant in the receiver to maintain adequate levels of liquid refrigerant therein. Heretofore these problems have been dealt with by various modifications to the system, virtually all of which are dependent upon temperatures and pressures within the system. It has now been found that a relatively simple modification of a conventional vapor-compression refrigeration system can overcome such common problems, the modification allowing the system to function efficiently independently of temperatures and pressures within the system.

SUMMARY OF THE INVENTION

It has been found that the provision of a liquid refrigerant level sensor in the condensor drain line before the receiver, coupled with a valve responsive to the sensor in the high pressure vaporous line leading to the receiver, and with a trapping of the drain line so as to allow it to be in fluid communication both with the receiver and with the expansion device so as to form a liquid seal with the liquid refrigerant in the receiver, all in a conventional refrigeration system, allows greatly enhanced efficiencies in the operation of the so-modified system. Exemplary efficiencies include the maintenance of the stability of the refrigerant over a wide range of changes in compressor pressures and ambient conditions, elimination of the need to flood the condensor with liquid refrigerant, reduction of the need for storage of excess liquid refrigerant in the receiver, thereby resulting in a reduction of the total amount of refrigerant required in the system, and a decrease in energy consumption of from 10% to 60%, depending upon ambient temperatures.

DETAILED DESCRIPTION OF THE INVENTION

Figure 1:
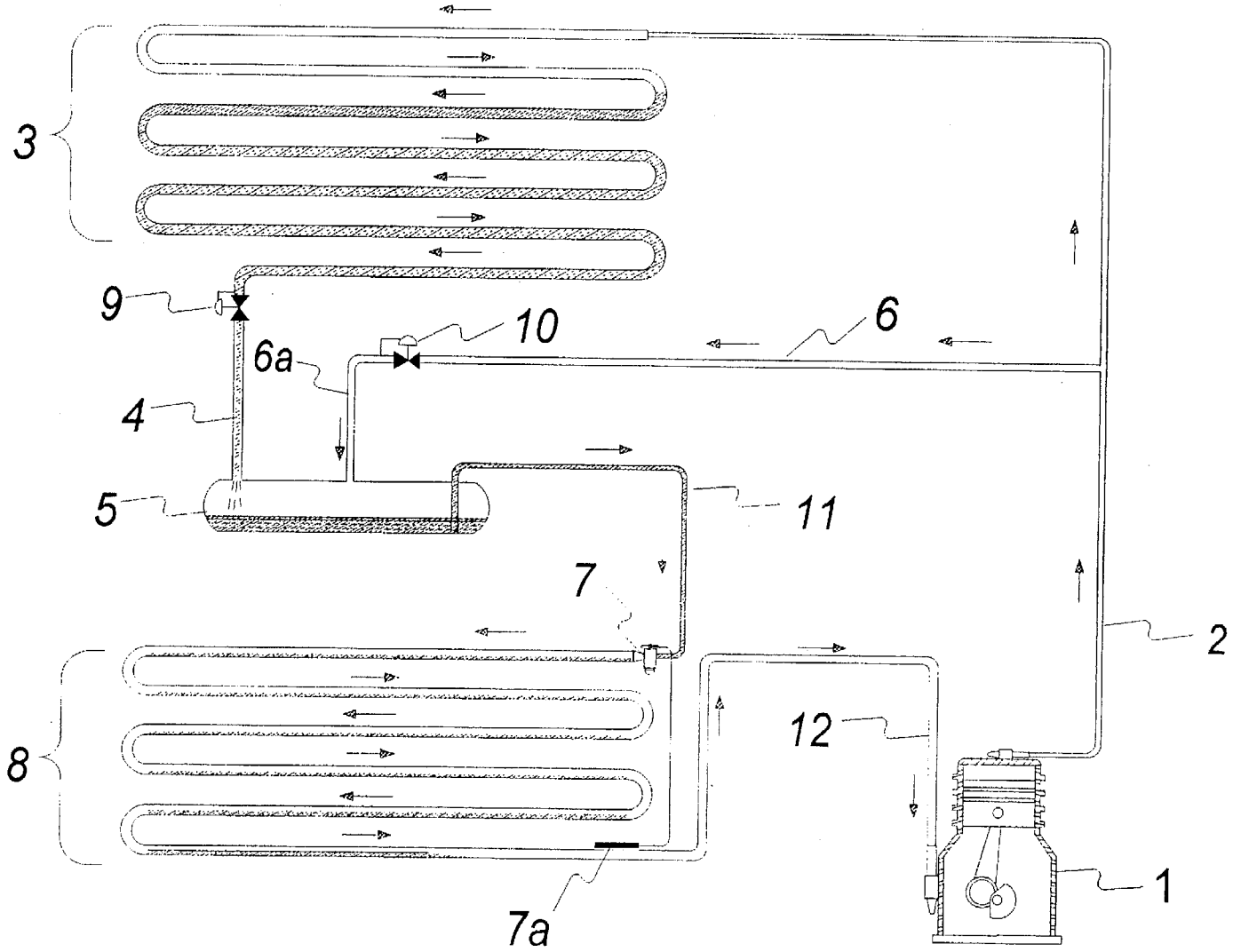
FIG. 1 is a schematic of a conventional vapor-compression air conditioning or refrigeration system.

Turning now to the drawings, wherein like numerals refer to the same elements, there is shown in FIG. 1 a schematic of a conventional refrigeration system wherein the cross-hatched area represents liquid refrigerant. A compressor 1 feeds compressed vaporized refrigerant at high pressure through vapor refrigerant conduit 2 to condensor 3, wherein it cools and condenses to liquid, thereby transferring heat to cold air, water or other fluid medium. The liquid refrigerant then enters the liquid refrigerant receiver or reservoir 5 via drain line 4. Reservoir 5 also receives vaporized refrigerant from vapor refrigerant conduit 2 via shunt line or conduit 6. Liquid refrigerant then passes through an expansion device 7 (such as an expansion valve, a capillary tube or a float assembly), whereby it partly vaporizes and cools upon entry into evaporator 8. The mixed liquid and vapor entering evaporator 8 is colder than its immediate environment and so absorbs heat from the interior of the refrigerator box or cold room and ultimately completely vaporizes prior to its entry into the intake side of compressor 1 via vapor conduit 12. Expansion device 7 is typically responsive to a temperature sensor 7*a*, permitting the passage of liquid refrigerant to evaporator 8 upon a rise in temperature above a predetermined set point.

As with the majority of systems, a method of compressor head pressure control has been essential to diminish the amount of premature vaporization of liquid refrigerant (flash gas) entering the expansion device, particularly when operating at colder ambient temperatures. FIG. 1 depicts the predominate method of controlling compressor head pressure, namely a refrigerant side head pressure control system. Pressures in reservoir 5 are controlled by the use of two valves 9 and 10. ORI valve 9 opens upon a rise of inlet pressure in vapor refrigerant conduit 2 thereby flooding condenser 3 with liquid refrigerant and reducing the effective condensing surface area, which in turn increases the compressor discharge pressure. Under low temperature ambient conditions the condenser 3 can be and often is 85% to 90% flooded with liquid refrigerant. This refrigerant serves no useful purpose other than to maintain sufficient pressure in reservoir 5 to assure a proper feed to the expansion device 7.

Refrigerant exiting ORI valve 9 is at a lower pressure than refrigerant in condenser 3. To minimize this pressure differential, pressure is increased by permitting an influx of pressurized vapor exiting the discharge of compressor 1 via shunt conduit 6, which is controlled by CRO valve 10, which closes upon a rise in the outlet pressure in vapor inlet conduit 6*a*, or opens upon a drop in the outlet pressure in the same conduit. To enable liquid refrigerant to enter reservoir 5, the pressure in the reservoir must be lower than the pressure setting of ORI valve 9. Typically CRO valve 10 is set at approximately 10 psi lower than the setting of ORI valve 9, which means that the liquid refrigerant in reservoir 5 is slightly below its saturation pressure. The combined operation of these two valves will result in a fixed minimum condensing pressure.

While this type of compressor head pressure control works quite well at normal condensing temperatures of 90°to 95° F., the instability of the refrigerant in reservoir 5 is more pronounced at significantly lower condensing temperatures and can result in vapor being introduced into a refrigerant pump if the system includes such a pump, unless proper Net Positive Suction Head (NPSH) is maintained. The present invention eliminates such a problem.

All refrigerant pumps require a NPSH. NPSH may be defined as the sum of the saturated pressure of the liquid refrigerant entering the refrigerant pump and the static pressure of the column of liquid above the pump, less any pressure reductions caused by any restrictions upon entry of the liquid refrigerant into the pump or by any changes in temperature of the liquid refrigerant entering the pump. The present invention will result in a two- to four-fold increase in NPSH in most systems.

Figure 2:
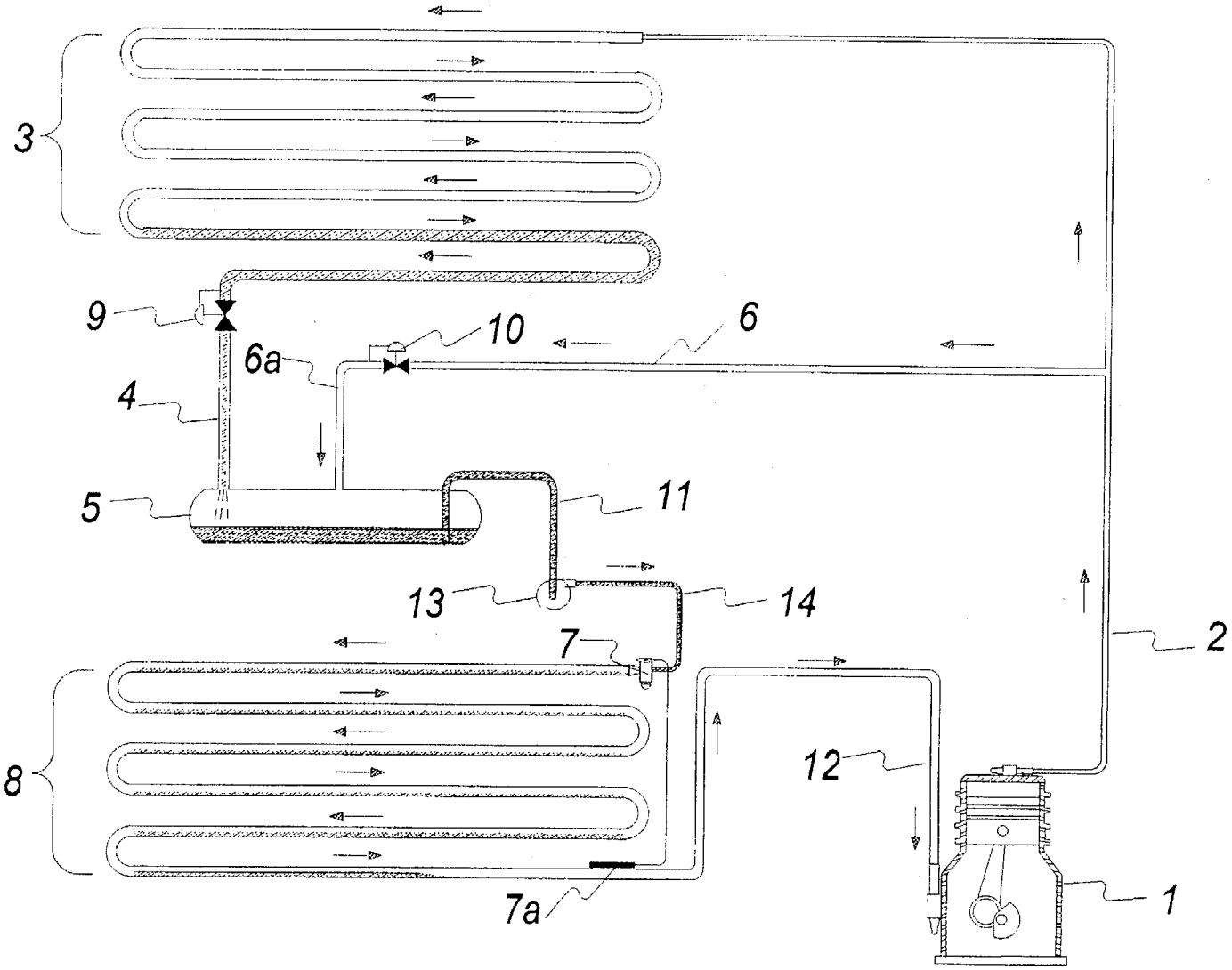
FIG. 2 is the same as FIG. 1, except for the inclusion of a refrigerant pump.

FIG. 2 is a schematic of a conventional vapor-compression refrigeration system modified in accordance with my U.S. Pat. No. 4,599,873 to include an in-line centrifugal refrigerant pump 13 to slightly increase pressure of the liquid refrigerant relative to that in reservoir 5, so as to help suppress flash gas and assure a proper feed to expansion device 7 via pump outlet conduit 14, allowing operation of the system at substantially lower compressor head pressure than the system illustrated in FIG. 1. Because the system in FIG. 2 can operate at and is set at a substantially lower minimum compressor head pressure, less liquid refrigerant is needed to flood the condenser and maintain the lower minimum discharge pressure setting. The cross-hatched area in FIG. 2 also represents liquid refrigerant, which is shown in FIG. 2 as being much smaller in total volume than that in FIG. 1 due to the substantially smaller amount needed in the condenser.

Figure 3:
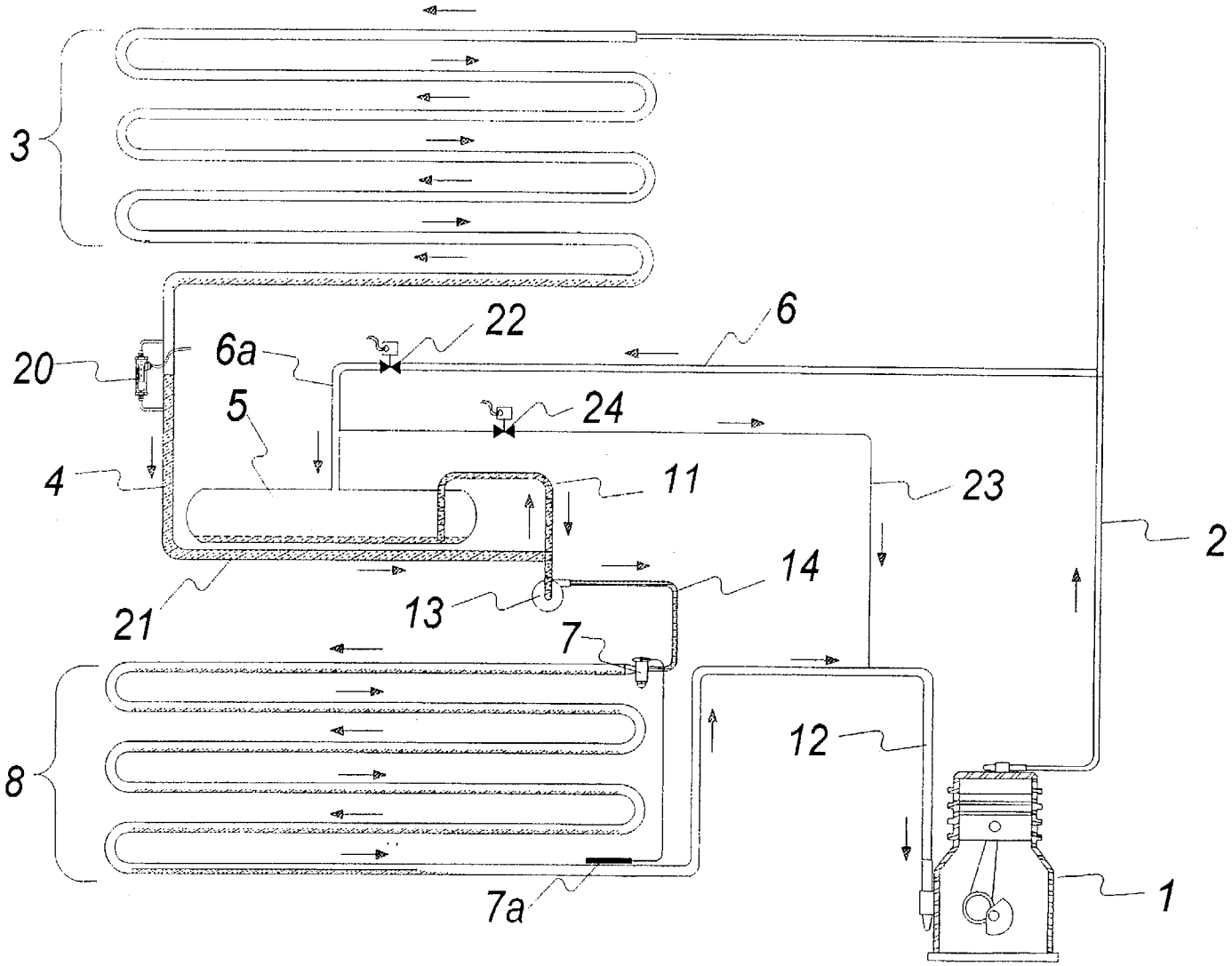
FIG. 3 is similar to FIG. 2, but includes the improvements of the present invention.

FIG. 3 is schematic of a conventional refrigeration system that has been modified in accordance with the present invention. In this system both ORI valve 9 and CRO valve 10 shown in FIGS. 1 and 2 have been eliminated. Instead of CRO valve 10, there is a servovalve 22 responsive to and controlled by a liquid refrigerant level sensor 20 in drain line 4. Drain line 4 does not directly enter reservoir 5 but rather is connected at a point between refrigerant pump 13 and the existing conduit 11 that exits the reservoir. Drain line 4 is trapped as shown in trap line 21 so as to prevent any vapor in the reservoir from reentering condenser 3, and maintains a liquid seal between the liquid refrigerant in the drain line and the liquid refrigerant in the reservoir.

Liquid level sensor 20 is preferably installed at that point in drain line 4 at which the installer determines would result in the proper NPSH for the refrigerant pump for the particular system or pump. To maintain the desired liquid refrigerant level in drain line 4, thereby maintaining the NPSH of pump 13, liquid level sensor 20 activates servovalve 22 via an electrical switch, the servovalve 22 in turn controlling the flow of higher pressure vapor exiting compressor 1 and entering reservoir 5 via conduit 6. When the liquid refrigerant level falls below a predetermined level in sensor 20, a contact in an electrical circuit is closed and servovalve 22 is opened to thereby pressurize reservoir 5 with vaporized refrigerant. With the higher pressure in the reservoir, some liquid refrigerant will exit the reservoir, thus increasing the amount of liquid refrigerant in the rest of the refrigeration system, at the same time returning the liquid refrigerant level in drain line 4 to the predetermined level in sensor 20. Upon reaching this level, servovalve 22 will close and will not open again until the liquid level again falls below the predetermined level.

Figure 4:
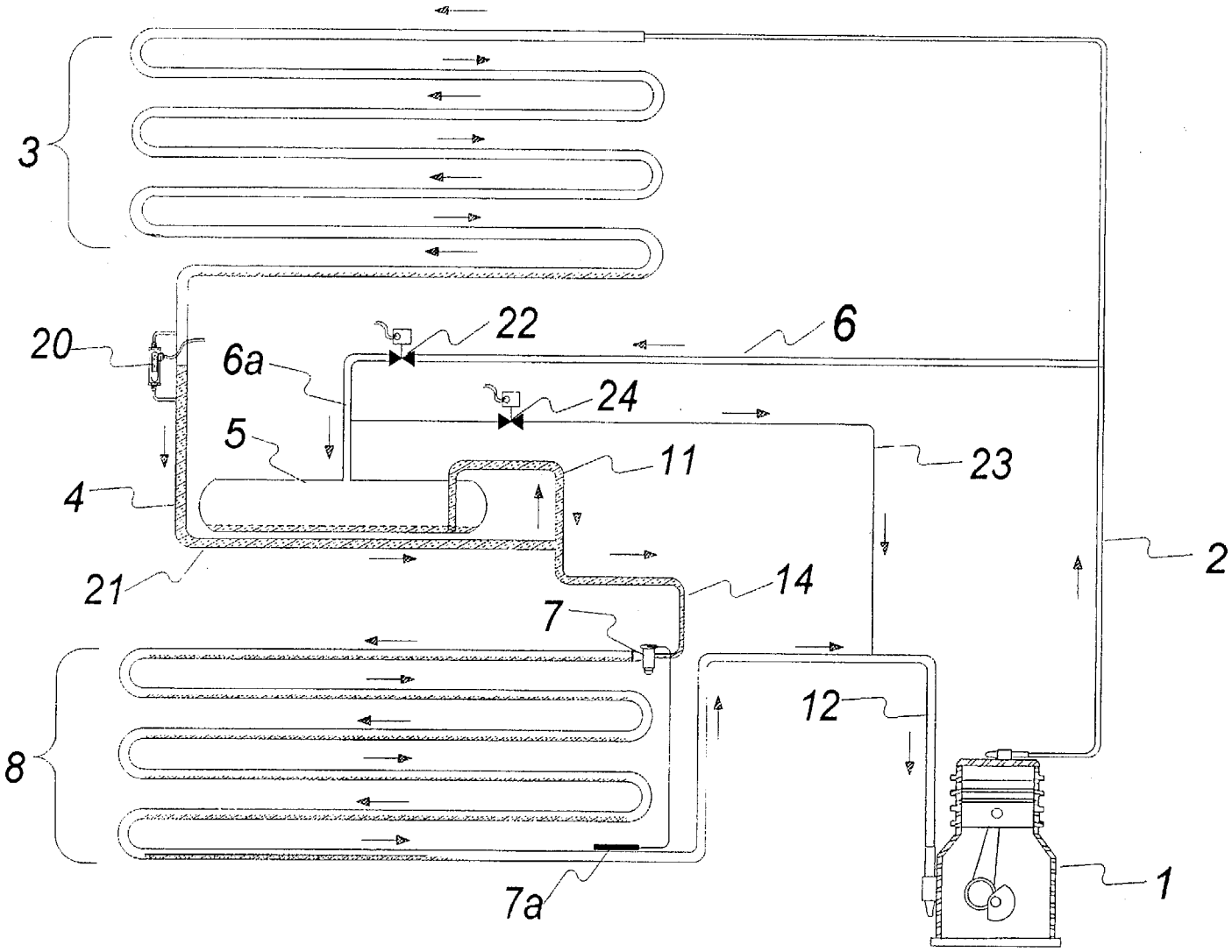
FIG. 4 is similar to FIG. 1, but includes the improvements of the present invention.

It has been found that at times the reservoir temperature exceeds the condensing temperature. If the temperature of the reservoir exceeds the condensing temperature, then the compressor head pressure will be controlled by the vapor pressure in the reservoir and will raise the compressor head pressure needlessly. The warmer reservoir temperature will then determine the condensing pressure. Vapor in the reservoir will stratify with the warmest vapor at the top. To prevent this from happening, a bleed line 23 of very small capacity (on the order of 1 to 3% of the flow capacity of conduit 6) is preferably installed. This bleed line may operate either by way of metered flow or be actuated by a bleed valve 24 that is responsive to sensor 20 by means of an electrical switch, opening when the level of the liquid refrigerant in sensor 20 is at the predetermined level, and closing when the liquid level falls below that set point. Venting a small amount of this warm vapor in the reservoir back into the low side of the refrigeration system via bleed line 23 and conduit 12, as shown in FIGS. 3 and 4, will alleviate any build-up of warm vapor or unwanted pressure in the reservoir.

The present invention is particularly useful when a liquid refrigerant pump is part of the refrigeration system. The reservoir often is located at or near the level of the floor and proper NPSH for the pump is not available unless the reservoir is raised or the pump is located below the floor level. The level and therefore the NPSH of a refrigerant pump may be preselected by selective placement of the liquid refrigerant level sensor, the height of which will determine the static head of the refrigerant entering the pump or liquid line. For example, if one wishes the static head of pressure to be a two foot column, then sensor 20 should be installed two feet above the center line of the inlet of the refrigerant pump. With this modification the liquid refrigerant entering the reservoir is always stable regardless of ambient temperature or compressor head pressure.

Although the present invention is more important for systems using a liquid refrigerant pump, it also offers an improvement for systems not using such a pump in that the slight increase in pressure above the saturation pressure of the liquid refrigerant entering conduit 14 to expansion device 7 will assist in the reduction of the production of "flash gas" or premature vaporization of liquid refrigerant. Such a refrigeration system is illustrated in FIG. 4.

Controlling system pressures by the present invention requires only a few pounds of pressure drop through the condenser, which is above the minimum pressure drop that would be encountered in air-cooled or water-cooled condensers. The pressure increase in the reservoir is modest. As an example, a two pound pressure increase on top of the reservoir will result in a four foot column of liquid refrigerant in the drain line above the level of liquid refrigerant in the reservoir. In addition, the present invention allows conversion of a flow-through reservoir to a more efficient surge-type reservoir, whereby the coldest liquid refrigerant bypasses the reservoir, where it often absorbs unwanted heat, and is routed directly to the expansion device. This colder liquid refrigerant reduces thermal loss associated with any warming of the refrigerant in the reservoir.

EXAMPLE

A refrigeration system of substantially the same design shown in FIG. 3 except for bleed line 23 and bleed valve 24 was constructed and operated at ambient temperatures ranging from 40° F. to 85° F. over a period of five months. Actual condensation took place at temperatures averaging 55° F. as compared to average condensation fixed temperatures of 95° F. for the same system not modified in accordance with the invention, representing a 40% decrease in energy consumption. Prior to installation of sensor 20, servovalve 22 and trap line 21, the gauge in reservoir 5 showed the reservoir to vary between 15% and 65% full, varying directly with the variation in ambient temperature. After the modification, the gauge consistently showed the reservoir to be 65% full over the entire ambient temperature range of 45° for the entire five month period of operation, thereby eliminating the need to periodically flood the condenser with liquid refrigerant when operating at cooler ambient temperatures, and demonstrating that the system needed far less refrigerant in the condensor under such conditions.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. In a vapor-compression refrigeration apparatus utilizing a fluid refrigerant and comprising a compressor, a condenser, a condenser drain line, a liquid refrigerant reservoir, a vaporous refrigerant shunt line, an expansion device, and an evaporator, said shunt line being in fluid communication with said reservoir and said reservoir being in fluid communication with said drain line and with said shunt line and with said expansion device, the improvement comprising:

a liquid refrigerant level sensor in said drain line and a shunt valve in said shunt line responsive to said sensor by means of an electrical switch, wherein said drain line is also in fluid communication with said expansion device, and a refrigerant bleed line between said shunt line and said evaporator.

2. The apparatus of claim 1 including a bleed valve in said bleed line.

3. The apparatus of claim 2 wherein said bleed valve is responsive to said sensor by means of an electrical switch.

4. The apparatus of claim 1 including a pump that is in fluid communication with said drain line, with said reservoir and with said expansion valve.

5. The apparatus of claim 1 wherein said fluid refrigerant is a halogenated hydrocarbon.

6. The apparatus of claim 1 wherein said fluid refrigerant is ammonia.

* * * * *